US006732985B1

(12) United States Patent
Cantrell

(10) Patent No.: US 6,732,985 B1
(45) Date of Patent: May 11, 2004

(54) BEACH UTILITY POLE

(76) Inventor: Douglas Chet Cantrell, 3259 Stonebridge Dr., Belleville, IL (US) 62221

( * ) Notice: Subject to any disclaimer, the term of this patent is extended or adjusted under 35 U.S.C. 154(b) by 0 days.

(21) Appl. No.: 10/369,487

(22) Filed: Feb. 20, 2003

(51) Int. Cl.[7] ..... A47F 5/00; A47F 7/00; F16M 11/00; F16M 13/00

(52) U.S. Cl. ..... 248/125.1; 248/156; 248/304

(58) Field of Search ..... 248/125.3, 156, 248/121, 533, 122.1, 125.8, 176.1, 304

(56) References Cited

U.S. PATENT DOCUMENTS

| | | | | | |
|---|---|---|---|---|---|
| 670,144 | A | | 3/1901 | Bond | |
| 2,805,109 | A | | 9/1957 | Kopmar | |
| 2,924,338 | A | | 2/1960 | Sharp | |
| 3,021,960 | A | | 2/1962 | Pipe | |
| 3,194,403 | A | * | 7/1965 | Van Horn, Jr. | 211/78 |
| 3,515,285 | A | * | 6/1970 | Wilkes | 211/85.19 |
| 3,624,732 | A | | 11/1971 | Bowden | |
| 4,154,255 | A | | 5/1979 | Weaver | |
| 4,832,304 | A | * | 5/1989 | Morgulis | 248/533 |
| 5,046,699 | A | * | 9/1991 | Perreault et al. | 248/533 |
| 5,143,108 | A | | 9/1992 | Kenney | |
| 5,161,561 | A | * | 11/1992 | Jamieson | 135/16 |
| 5,318,189 | A | | 6/1994 | Lee | |
| 5,823,360 | A | * | 10/1998 | Gorosave | 211/13.1 |
| 5,855,286 | A | * | 1/1999 | Zaid | 211/87.01 |
| 5,878,762 | A | * | 3/1999 | Huang | 135/16 |
| 5,899,571 | A | | 5/1999 | Chalk | |
| 6,018,926 | A | | 2/2000 | Chen-Chao | |
| 6,401,656 | B1 | * | 6/2002 | Adkisson | 119/51.01 |
| 6,443,172 | B2 | | 9/2002 | Brumfield | |
| 6,487,977 | B1 | * | 12/2002 | Williams et al. | 108/50.12 |
| 6,578,719 | B1 | * | 6/2003 | Finn | 211/70.2 |

OTHER PUBLICATIONS

US 2002/0166928 A1 (Johnson) Nov. 14, 2002 "Device for Holding Camping Items".*

US 2002/0027182 A1 (Eppley) Mar. 7, 2002 "Soli/Sand Stand Unit with Utilities".*

* cited by examiner

*Primary Examiner*—Ramon O. Ramirez
*Assistant Examiner*—Amy J. Sterling
(74) *Attorney, Agent, or Firm*—Michael I. Kroll

(57) ABSTRACT

The present invention 10 discloses a multi-segmented central post member with upper 18, middle 26, and lower 28 sections having a cup-holding element 24, a utility member 22 and a clothes-hanging element 16 having a plurality of hook members 40 extending therefrom. The post segments have compatible male 36 and female threads 38 on their respective ends for establishing a rectilinear connection to the mating post segment. The bottom segment has a first end 44 which is tapered for easy insertion in sand or turf 12. The threaded male portions 36 of the post segments are radially offset from the outer circumference to form retaining flanges 42 for the accessory units. The ends of the post segments with the threaded female recesses 38 have a similar retaining flange. The accessory units 16, 22, 24 have central recesses with a diameter slightly greater than the threaded male portion 36 but less than the diameter of the post segment thereby engaging the post segment during assembly by inserting the threaded male portion 36 through the central recess. A mesh tote bag 32 is provided for transport and storage. An elastic cord 20 is provided wherein one end thereof passes through a retaining aperture 30 of one post segment and the other end thereof passes through the retaining aperture 30 on another post segment. An auger-like tip 50 on the tapered end of the bottom post segment 28 is also disclosed.

13 Claims, 12 Drawing Sheets

BEACH UTILITY POLE

BACKGROUND OF THE INVENTION

1. Field of the Invention

The present invention relates generally to utility posts for hanging accessories and, more specifically, to a segmented utility post for outdoor use having an array of accessory units that may be selectively installed thereon by the user as needed.

The primary components of the present invention comprise a multi-segmented post member, a cup-holding element, an elongate horizontal plate member for hanging bags and other such items, and a clothes-hanging element having a plurality of hook members extending therefrom. The multi-segmented post member comprises a bottom post segment, at least one medial post segment and a top post segment. The various post segments have compatible male and female threads on their respective ends for establishing a rectilinear connection to the mating post segment. The bottom segment has a first end, which is tapered for easy insertion in sand or turf, and a second end having threaded male portion. Each medial post segment has a threaded male portion and a threaded female recess on the opposing end. The top post member has a threaded female recess in the lower end and a substantially planar top. The threaded male portions of the post segments are radially offset from the outer circumference to form retaining flanges for the accessory units. The ends of the post segments with the threaded female recesses have a similar retaining flange.

The accessory units have central recesses with a diameter slightly greater than the threaded male portion but less than the diameter of the post segment thereby enabling the user to engage the accessory unit with the post segment during assembly by inserting the threaded male portion through the central recess. Once the accessory unit is seated on the retaining flange, the user threads the threaded female recess of the next post segment onto the threaded male portion with the accessory unit thereby firmly binding the accessory unit therebetween.

The present invention breaks down into a plurality of smaller components for placement in the mesh tote bag for transport and storage. When the present invention is assembled and installed the mesh tote bag may be hung from the clothes-hanger element or the utility hanger for the placement of articles.

An elastic cord is provided that is secured on one end to the retaining recess of one post segment and on the other to the retaining recess on another post segment. The elastic cord is used to retain articles in a versatile, accessible manner.

An auger-like tip on the tapered end of the bottom post segment may also be included to securely anchor the beach utility post. The user may grasp the utility handle on the fully assembled beach utility post to provide greater leverage when rotating the post to burrow the auger-like tip deeper into the ground for the enhanced stability thereof.

2. Description of the Prior Art

There are other utility post devices designed for securing articles. Typical of these is U.S. Pat. No. 670,144 issued to C. E. Bond on Mar. 18, 1901.

Another patent was issued to S. Kopmar on Sep. 3, 1957 as U.S. Pat. No. 2,805,109. Yet another U.S. Pat. No. 2,924,338 was issued to B. C. Sharp on Feb. 9, 1960 and still yet another was issued on Feb. 20, 1962 to J. Pipe as U.S. Pat. No. 3,021,960.

Another patent was issued to L. N. Bowden on Nov. 30, 1971 as U.S. Pat No. 3,624,732. Yet another U.S. Pat. No. 4,018,191 was issued to R. Weaver on May 15, 1979. Another was issued to R. J. Kenney on Sep. 1, 1992 as U.S. Pat. No. 5,143,108 and still yet another was issued on Jun. 7, 1994 to Cheol J. Lee as U.S. Pat. No. 5,318,189. Another patent was issued to T. Chalk on May 4, 1999 as U.S. Pat. No. 5,899,571. Yet another U.S. Pat. No. 6,018,926 was issued to C. C. Huang on Feb. 1, 2000. Another was issued to D. U. Brumfield on Sep. 3, 2002 as U.S. Pat. No. 6,443,172.

U.S. Pat. No. 670,144

Inventor: Charles E. Bond

Issued: Mar. 19, 1901

In a combination with a stake having transverse openings, a bracket comprising an arm or shank adjustable in the transverse opening of the stake and provided at one end with a shelf and having its opposite end constructed to hold the vessel in suspension, substantially as specified.

U.S. Pat. No. 2,805,109

Inventor: Samuel Kopmar

Issued: Sep. 3, 1957

An attachment for a beach umbrella comprising a rigid disc having a central aperture and a plurality of apertures around said central aperture, a smaller central member secured beneath said disc and provided with apertures registering with the apertures in said disc, beverage receptacles secured in position between said disc and provided with apertures registering with the apertures in said disc, beverage receptacles secured in position between said disc and said central member in alignment with those apertures around the central aperture, a tubular collar depending from said central member axially of the central apertures for the sliding passage of a beach umbrella shaft and means for clamping the collar and hence the attachment to such shaft.

U.S. Pat. No. 2,924,338

Inventor: Bruce C. Sharp

Issued: Feb. 9, 1960

A support for beach articles comprising an upright column, a flat vertical member, a lower horizontal member, and an upper horizontal member, the column having a vertical slot formed in the upper end, the flat vertical member passing through the slot of the column and having horizontal slots, the lower horizontal member engaging in one of the horizontal slots of the vertical member and having a circular opening surrounding the column and the upper horizontal member engaging in another of the horizontal slots of the vertical member and extending laterally of the column.

U.S. Pat. No. 3,021,960

Inventor: John Pipe

Issued: 3,021,960

A knocked down clothes rack structure comprising a base; a rectilinear hollow post secured to said base, said post having a plurality of apertures spaced about the periphery and located in the sides thereof, a plurality of hangers having flanges thereof abutting against the sides of said post; insert means positionable in said post; said insert means having means for receiving said flanges, and guide means formed on said insert means, said guide means engaging the sides of said post for automatically aligning said means for receiving said flanges with said hanger flanges, said insert means engaging said flanges for clamping them between said insert and said post whereby clothes may be supported from said hangers.

U.S. Pat. No. 3,624,732

Inventor: Lloyd M. Bowden

Issued: Nov. 30, 1970

A quick adjustment self-protective beach umbrella tray with a central sleeve having special means for fitting umbrella shafts, including in various embodiments spring retention with and without cooperative thimble inserts. The table is provided with recesses for receiving sundry articles and in one embodiment with stiffening ribs.

U.S. Pat. No. 4,154,255

Inventor: Robert Weaver

Issued: May 15, 1979

A novel article retaining web for use with beach umbrellas is disclosed. The web is designed for use with an umbrella having a central supporting pole, a plurality of spokes pivotally attached thereto and a plurality of struts extending from a position along the pole generally upwardly to engage the spokes to brace the same when the umbrella is in the open position. The web is characterized by a substantially circular flexible net having a central aperture defined therein, a substantially inelastic reinforcing strip disposed around the perimeter of the net, and a plurality of attachments periodically disposed along the reinforcing strip, one for each spoke of the umbrella for suspending the web from the umbrellas spokes. The sizing and spacing of the above-mentioned components is such that article access apertures are created between portions of the umbrella located between the spokes and the portions of the webbing suspended from those spokes.

U.S. Pat. No. 5,143,108

Inventor: Robert J. Kenney

Issued: Sep. 1, 1992

A portable beach umbrella is provided having a plurality of rotatable accessible utility levels for storing necessary beach equipment. The umbrella also includes a refreshment support member, entertainment devices, and is easily secured to sand or ground for stability while in use.

U.S. Pat. No. 5,318,189

Inventor: Cheol J. Lee

Issued: Jun. 7, 1994

A coat rack comprising replaceable rack pieces rotatably mounted on a pillar rod and having stationary pieces disposed between each rack piece, an ornamental top mounted to an uppermost stationary piece held in place by a hollow square piece and a corresponding cap piece.

U.S. Pat. No. 5,899,571

Inventor: Damon T. Chalk

Issued: May 4, 1999

A combination beach towel, tote bag and beach umbrella system including a towel member, an umbrella member and an umbrella support. The towel member has a towel perimeter edge defining a towel shape, a drawstring sleeve provided adjacent to the towel perimeter, and a draw string having a first and second drawstring end positioned through the drawstring sleeve with the first and second drawstring ends extending out from the drawstring sleeve. The umbrella member has an umbrella perimeter defining an umbrella shape corresponding to the towel shape in a manner such that the umbrella perimeter and the towel perimeter can be placed in registration and four elongated, tubular shaped, fabric, pole attachment sleeves open at both ends thereof, each pole attachment sleeve attached to a first side of the umbrella member and extending from the umbrella perimeter radially toward the center of the umbrella member. The umbrella member and the towel members are securable together along their perimeters. The sectional umbrella support includes a two part vertical support pole including an umbrella spike having a diameter sized to pass through the umbrella spike aperture of the towel member, a central support having a first end adapted for connection with the vertical support pole and for horizontal support pole connecting members.

U.S. Pat. No. 6,018,926

Inventor: Huang Chen-Chao

Issued: Feb. 1, 2000

An improved banner pole structure includes a first cylindrical tube, a pole head, a second cylindrical tube, and a bias frictional assembly. The pole head is threadedly coupled to the first cylindrical tube and the first cylindrical tube is telescopically received within the second cylindrical tube. The bias functional assembly is coupled to an end of the first cylindrical tube and frictionally engages an interior wall surface of the second cylindrical tube, responsive to rotation of the first cylindrical tube relative to the second cylindrical tube.

U.S. Pat. No. 6,443,172

Inventor: Donald U. Brumfield

Issued: Sep. 3, 2002

A beach umbrella is supported with a stand having a lower shaft and an upper shaft, with the upper shaft supporting a beach umbrella mast. Before attaching the umbrella mast, the tubular upper shaft serves as an impact tool against a protuberance on the lower shaft, allowing hammering of the lower shaft into composite earth. The upper shaft telescopes onto the lower shaft securing a tray in place against the protuberance after hammering is completed.

While these utility poles devices may be suitable for the purposes for which they were designed, they would not be as suitable for the purposes of the present invention, as hereinafter described.

SUMMARY OF THE PRESENT INVENTION

The present invention discloses a multi-segmented central post member with upper, middle, and lower sections having a cup-holding element, a utility member and a clothes-hanging element having a plurality of hook members extending therefrom. The post segments have compatible male and female threads on their respective ends for establishing a rectilinear connection to the mating post segment. The bottom segment has a first end which is tapered for easy insertion in sand or turf. The threaded male portions of the post segments are radially offset from the outer circumference to form retaining flanges for the accessory units. The ends of the post segments with the threaded female recesses have a similar retaining flange. The accessory units have central recesses with a diameter slightly greater than the threaded male portion but less than the diameter of the post segment thereby engaging the post segment during assembly by inserting the threaded male portion through the central recess. A mesh tote bag is provided for transport and storage. An elastic cord is provided wherein one end thereof passes through a retaining aperture of one post segment and the other end thereof passes through the retaining aperture on another post segment. An auger-like tip on the tapered end of the bottom post segment is also disclosed.

A primary object of the present invention is to provide a portable, segmented utility post having a plurality of accessory attachments that may be selectively installed thereupon for storing articles common to beach and other such related outdoor activities.

Another object of the present invention is to provide a portable, segmented utility post having a plurality of accessory attachments that may be broken down into easily stored components that can be stored in a mesh tote bag for transport and storage.

Yet another object of the present invention is to provide a portable, segmented utility post having a plurality of accessory attachments having mesh tote bag that may be suspended from the utility post for containing articles that would otherwise clutter a beach blanket, picnic table or other such recreational area.

Still yet another object of the present invention is to provide a portable, segmented utility post having a plurality of accessory attachments that may be selectively installed by the user.

Another object of the present invention is to provide a portable, segmented utility post having a plurality of accessory attachments that is adjustable in height according to the users needs depending on how many medial post segments are installed therein.

Yet another object of the present invention is to provide a portable, segmented utility post having a plurality of accessory attachments having a tapered end that may also have an auger-like tip for effective penetration into sand and turf.

Still yet another object of the present invention is to provide a portable, segmented utility post having a plurality of accessory attachments that is simple and easy to use.

One other object of the present invention is to provide a portable, segmented utility post having a plurality of accessory attachments that is inexpensive to manufacture and operate.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
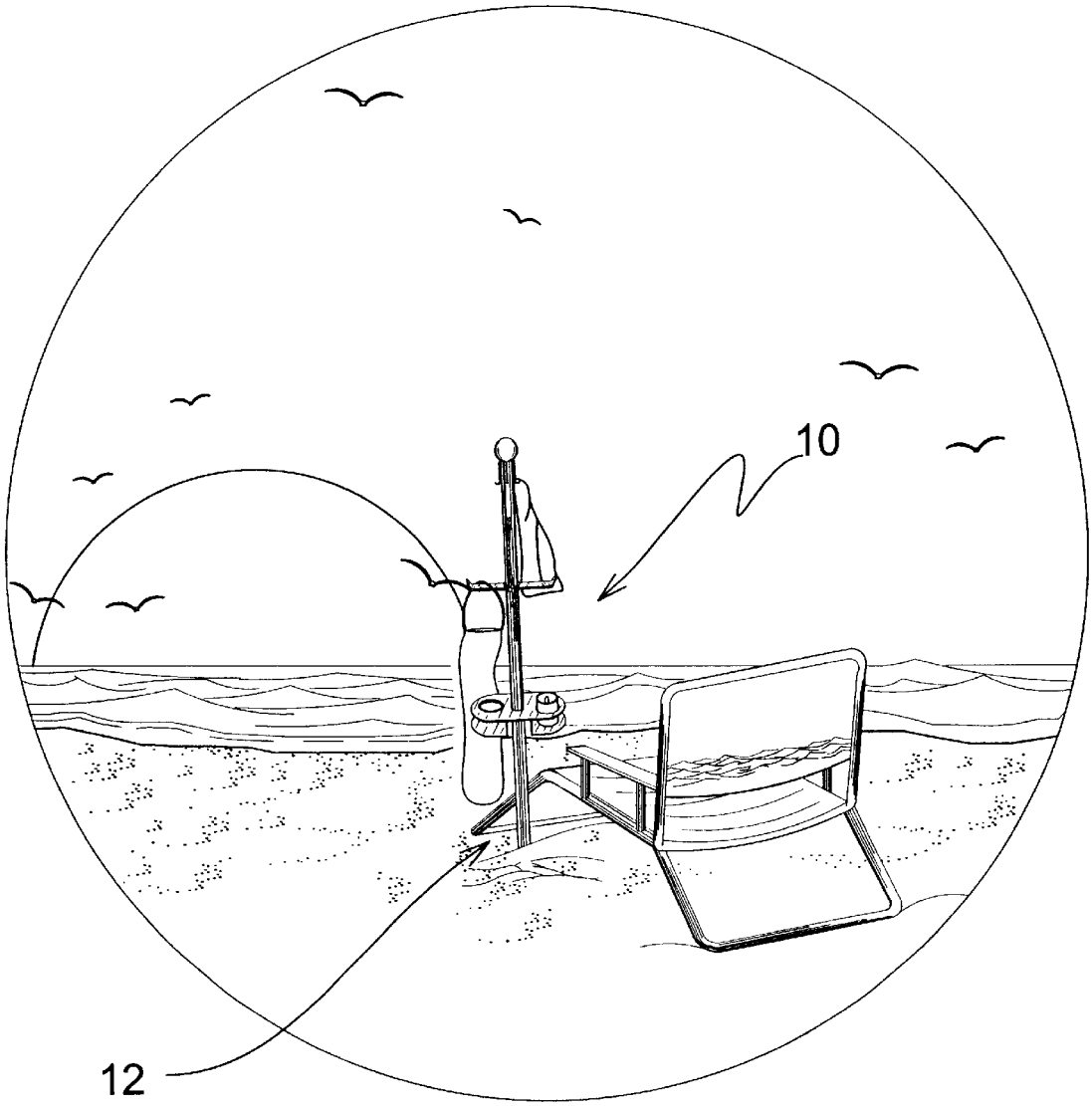
FIG. 1 is an illustrative view of the present invention.

With regard to reference numerals used, the following numbering is used throughout the drawings.

10 present invention
12 soil
14 securing element
16 clothes hanger element
17 ring
18 top post segment
20 elastic cord
22 utility hanger
24 cup holder
26 middle post segment
28 bottom post segment
30 aperture
32 bag
36 threaded male end
38 threaded female end
40 hook

42 retaining flange

44 tapered point

46 extruded surface

48 retaining recess

50 auger tip

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is the present invention 10 which consists of a segmented post in which a number of accessory units are bound between the joining segments of the pole therefore adding to its functionality. The invention is seated into sand or other soil 12 to maintain its upright position.

Figure 2:
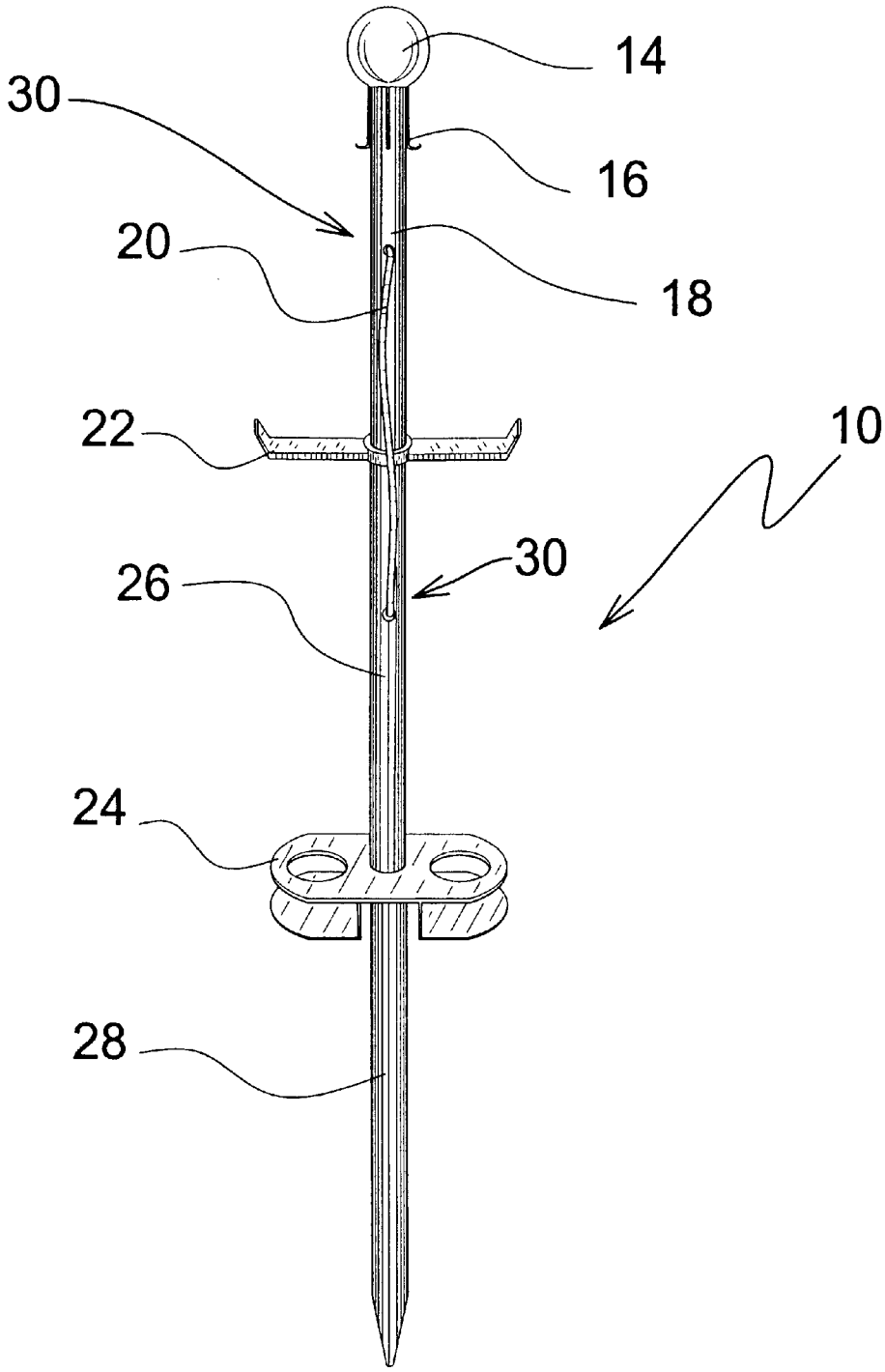
FIG. 2 is a perspective view of the present invention fully assembled.

Turning to FIG. 2, shown therein is a perspective view of the present invention 10. Shown is the present invention 10 fully assembled. At the top of the invention is the securing element 14, shown here as an elastomeric ball that fits tightly over the clothes-hanger element 16 and the outermost edge of the top post segment 18. The elastic cord 20 is fastened through apertures 30 in adjacent pole segments creating another storage feature to the invention. Attachments including the utility hanger 22 and cup holder 24 are bound between the pole segments. The bottom post segment 28 is tapered for easy penetration into the surface where it would be used. Also shown is the middle post segment 26.

Figure 3:
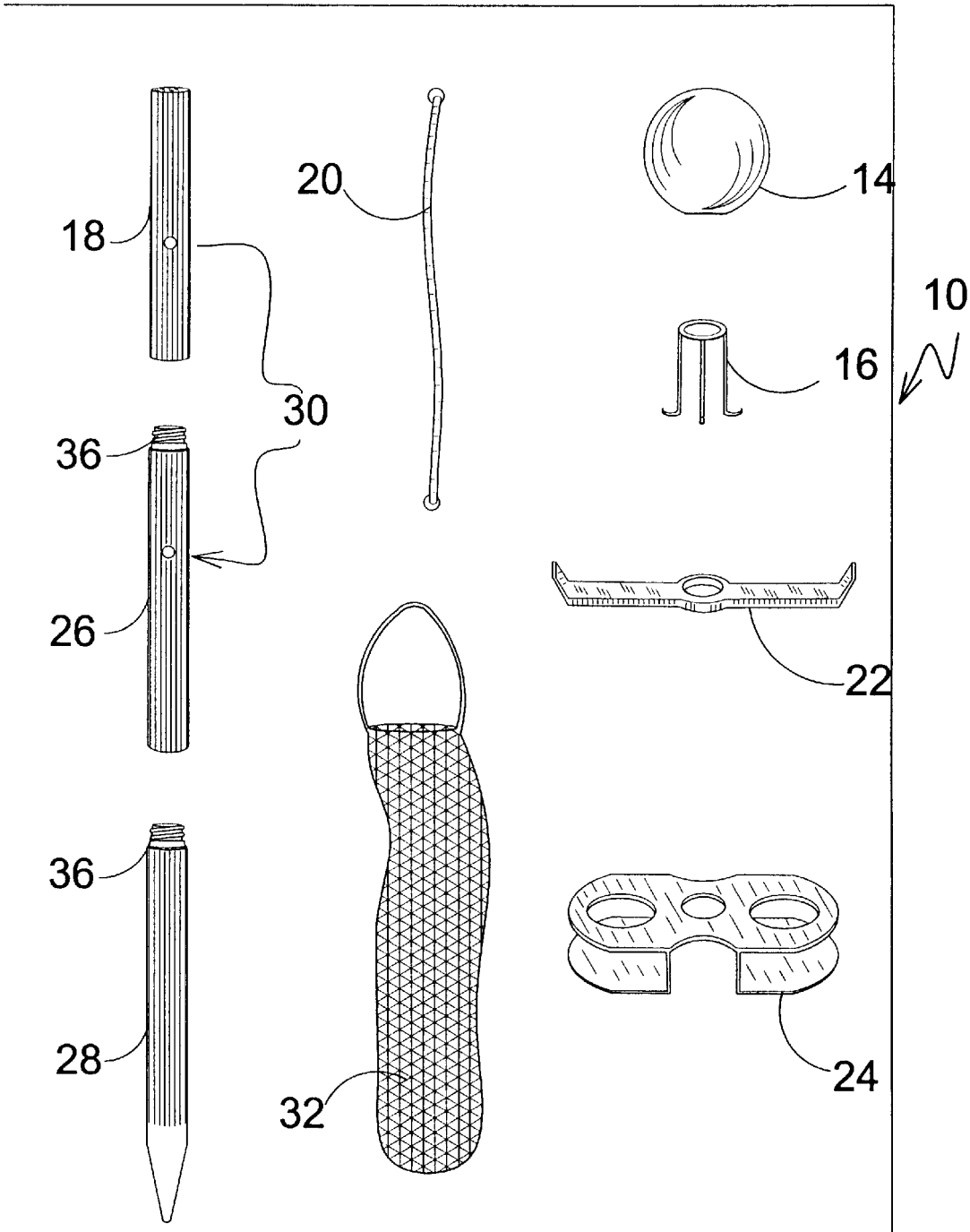
FIG. 3 is perspective view of the components of the present invention.

Turning to FIG. 3, shown therein are the components of the present invention 10.

The present invention 10 has a segmented post in which a number of attachments, i.e., securing element 14, coat hanger 16, utility hanger 22 and cup holder 24, could be added to increase its functionality. The invention has a mesh carrying bag 32 wherein after assembly the bag would be hung onto one of the attachments and used to store personal items. For illustrative purposes the pole is shown having three sections, i.e., the top segment 18, middle segment 26 and bottom segment 28 but may be more according to the needs of the user. Also shown is elastic cord 20, apertures 30, and threaded male end 36.

Figure 4:
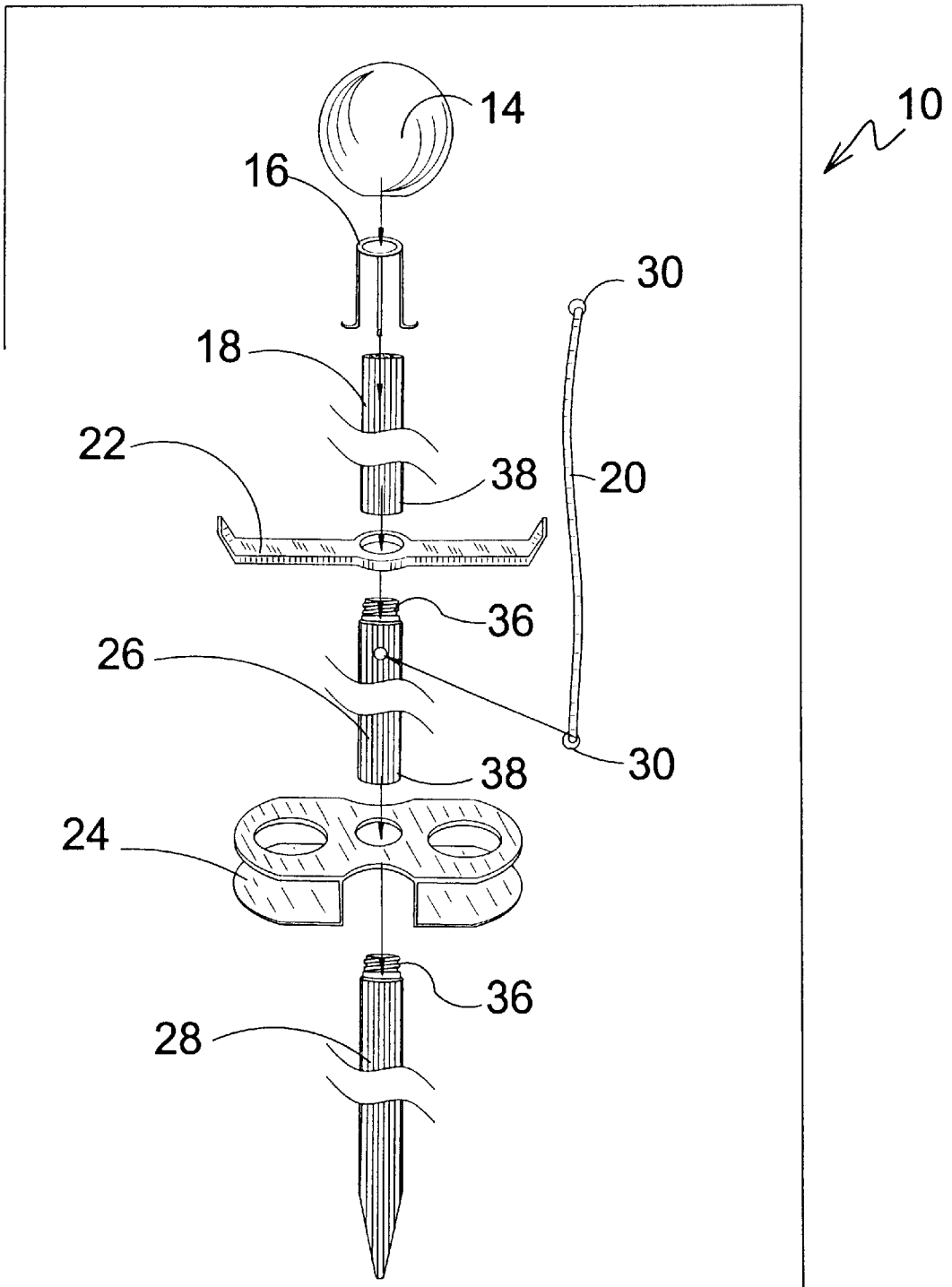
FIG. 4 is an exploded view of the present invention.

Turning to FIG. 4, shown therein is an exploded view of the present invention 10. Shown is the present invention 10 having a post comprised of a plurality of segments 18, 26, 28 with the mating segments having compatible mating male 36 and female 38 threaded ends whereby the post can be assembled and disassembled into a plurality of easily stored sections and accessories. The top end of the top post segment 18 has a planar surface whereupon a coat hanger hook element 16 is slid thereover until frictionally engaging the post section exterior wall. Once positioned an elastomeric ball-like member 14 is placed over the end of the post engaging the topmost part of the clothes-hanging element 16 and acts thereupon as a securing element 14. Positioned between the mating male and female threaded member are a number of accessory units 22, 24 providing additional functions to the segmented post. Also shown are the elastic cord 20 and apertures 30.

Figure 5:
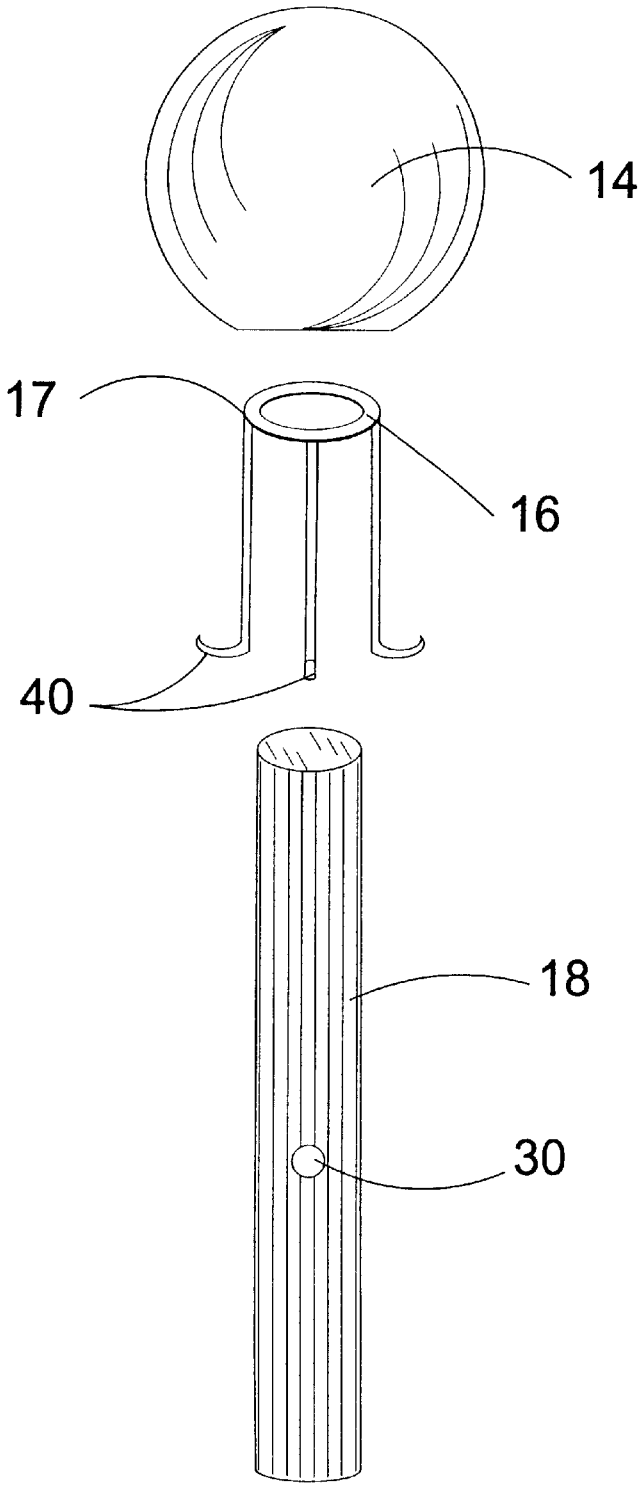
FIG. 5 is a partial perspective view of the clothes hanging element and securing attachment.

Turning to FIG. 5, shown therein is a perspective view of the clothes-hanger element 16 and its associated securing element 14. Shown is the top section 18 of the segmented support post having a clothes-hanger element 16 and ball-like securing attachment 14 ready to be installed on the topmost end of the post. The clothes-hanger 16 has a ring member 17 which frictionally engages the exterior wall of the post and the ball-like securing element 14 is placed onto the post 18 and over the top of the coat hanger 16 and ring 17 in order to secure it to the post 18. The coat hanger 16 provides means whereby a user can attach clothing or other items to the plurality of downwardly extending hooks 40 of the clothes-hanger. The ball-like securing element 14 is manufactured from an elastomeric material such as rubber as a safety feature as well as to secure the clothes hanger element 16 to the segmented post 18. Also shown is aperture 30.

Figure 6:
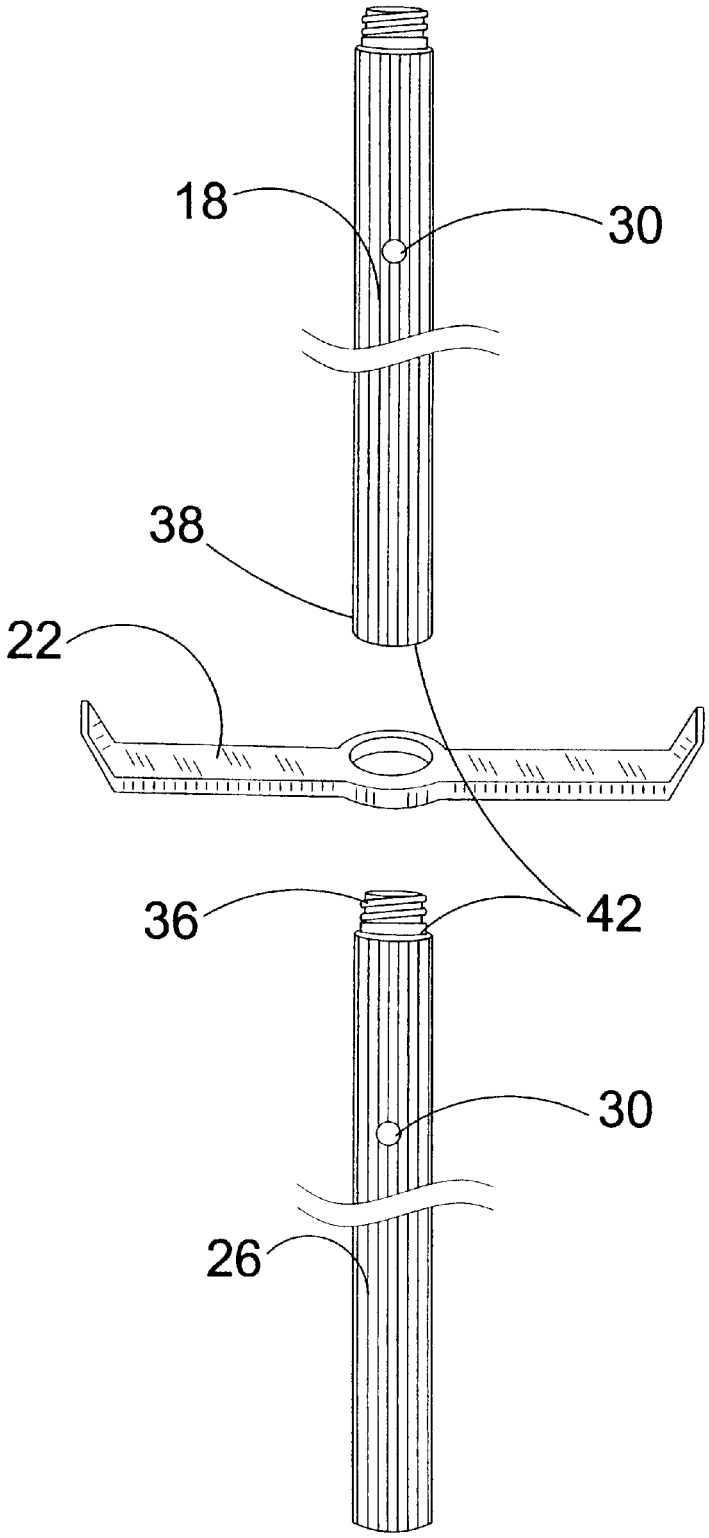
FIG. 6 is a perspective view of the utility hanger attachment.

Turning to FIG. 6, shown therein is a perspective view of the utility hanger attachment 22. Shown is a utility hanger attachment 22 between two of the post segments 18, 26 of the invention. The utility hanger attachment 22 is placed between the male 36 and female 38 end of the joining poles 18, 26 thereby locking attachment 22 tightly between the retaining flanges 42 of the two post segments 18, 26. Also shown is aperture 30 for receiving the elastic cord.

Figure 7:
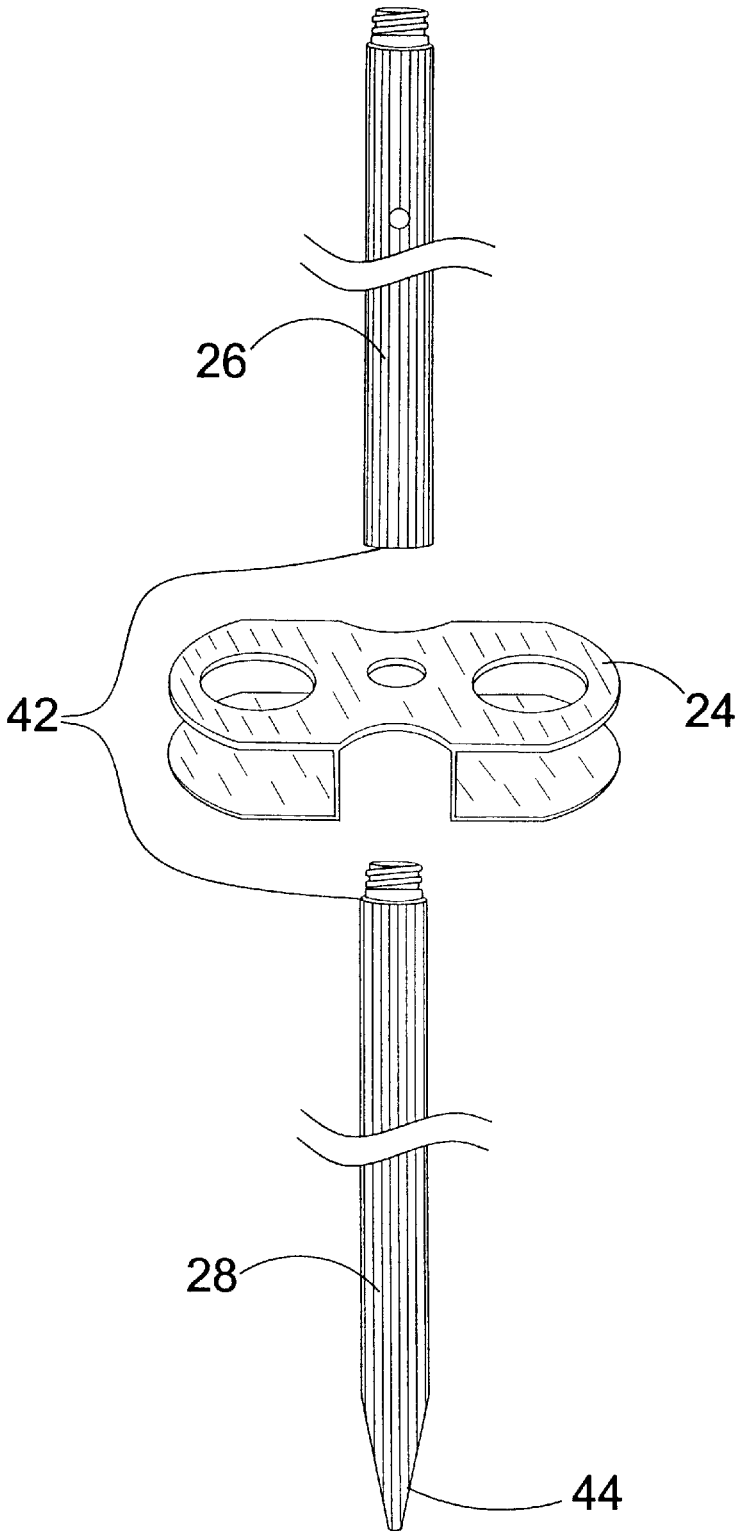
FIG. 7 is a perspective exploded view of the cup holder attachment, a bottom post segment and a medial post segment.

Turning to FIG. 7, shown therein is a perspective view of the cup-holder attachment 24. Shown is the cup holder attachment 24 positioned between two of the post segments 26, 28 of the present invention. The cup holder attachment 24 is locked between the retaining flanges 42 of the post segments 26, 28 making them all one unified piece of the present invention. Also shown is the tapered point end 44 of the bottom post 28 which will make insertion into sand or soil easier.

Figure 8:
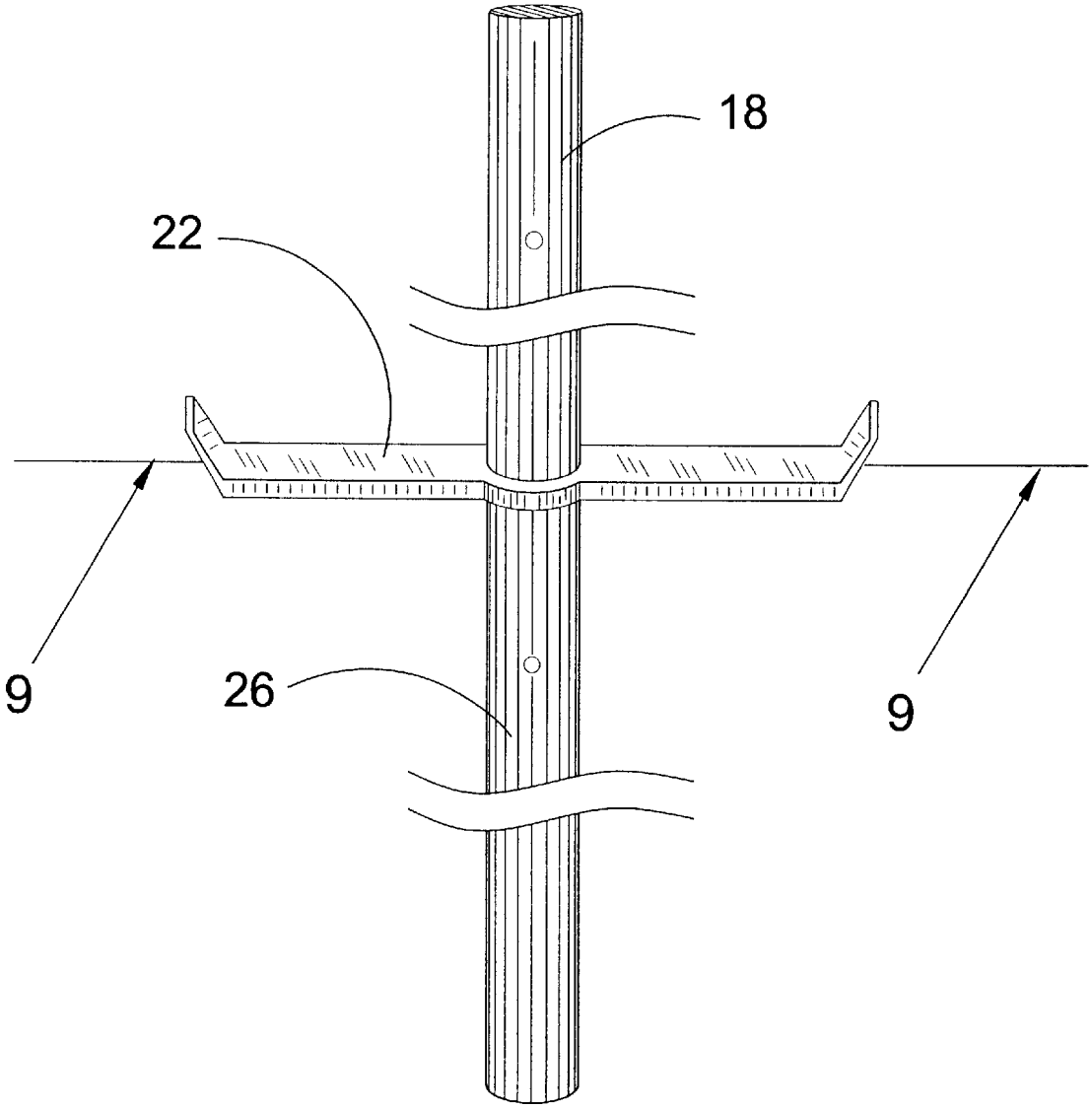
FIG. 8 is a perspective view of the utility hanger assembly installed.

Turning to FIG. 8, shown therein is a perspective view of the utility hanger 22 installed. This figure shows the utility hanger attachment 22 bound between two of the post segments 18, 26. The utility hanger 22 is located between the two retaining flanges as previously disclosed, bound tightly by the force of the male and female threads locking the post segments 18, 22 together.

Figure 9:
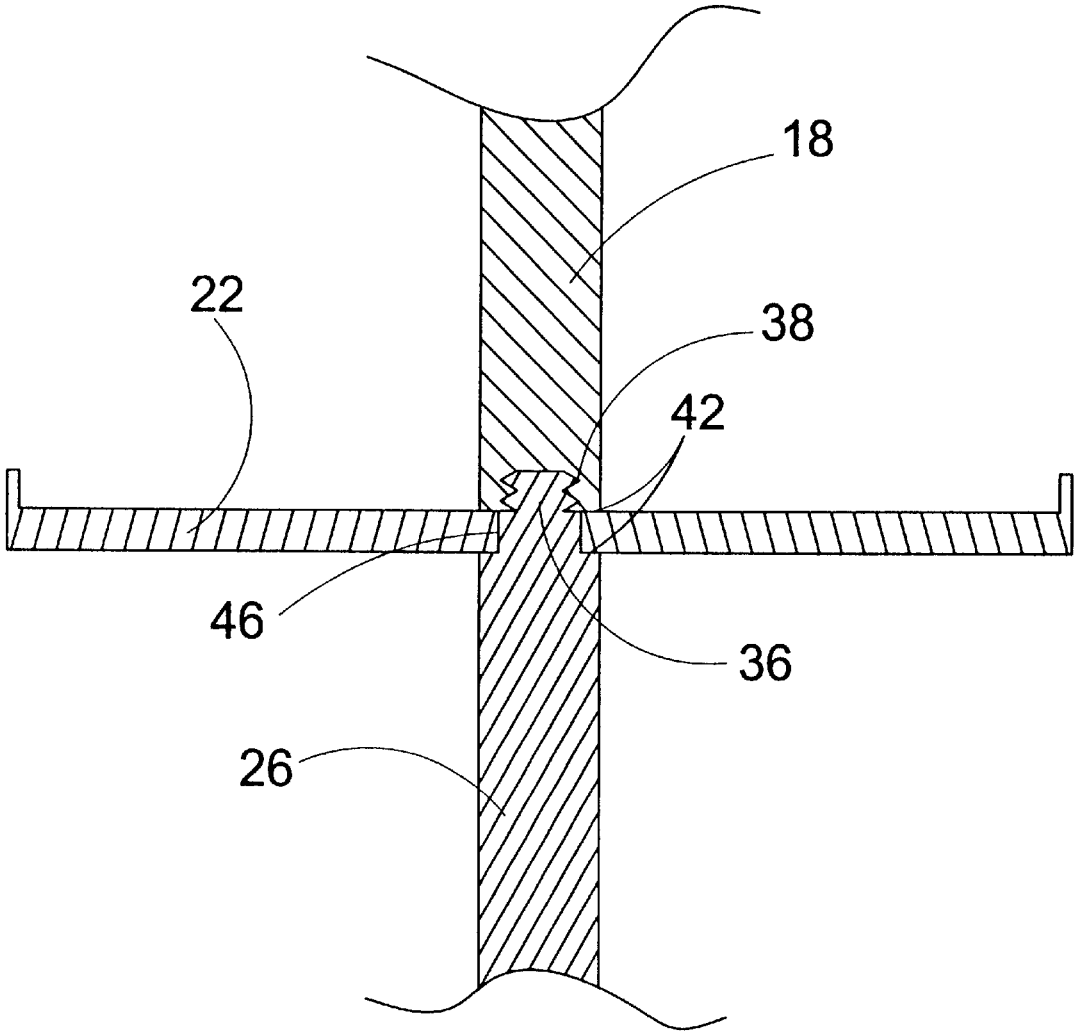
FIG. 9 is a cross sectional front view of the utility hanger attachment installed.

Turning to FIG. 9, shown therein is a sectional view of the utility hanger 22 assembly installed between two post segments 18, 26. This figure shows the male 36 and female 38 threaded ends of two post segments 18, 26 with the hanger attachment 22 locked between the two ends 36, 38. The hanger attachment 22 seats onto the male end that has a smooth extruded surface 46 which helps form retaining flange 42 preventing the hanger from touching the male threads 36 on the pole.

Figure 10:
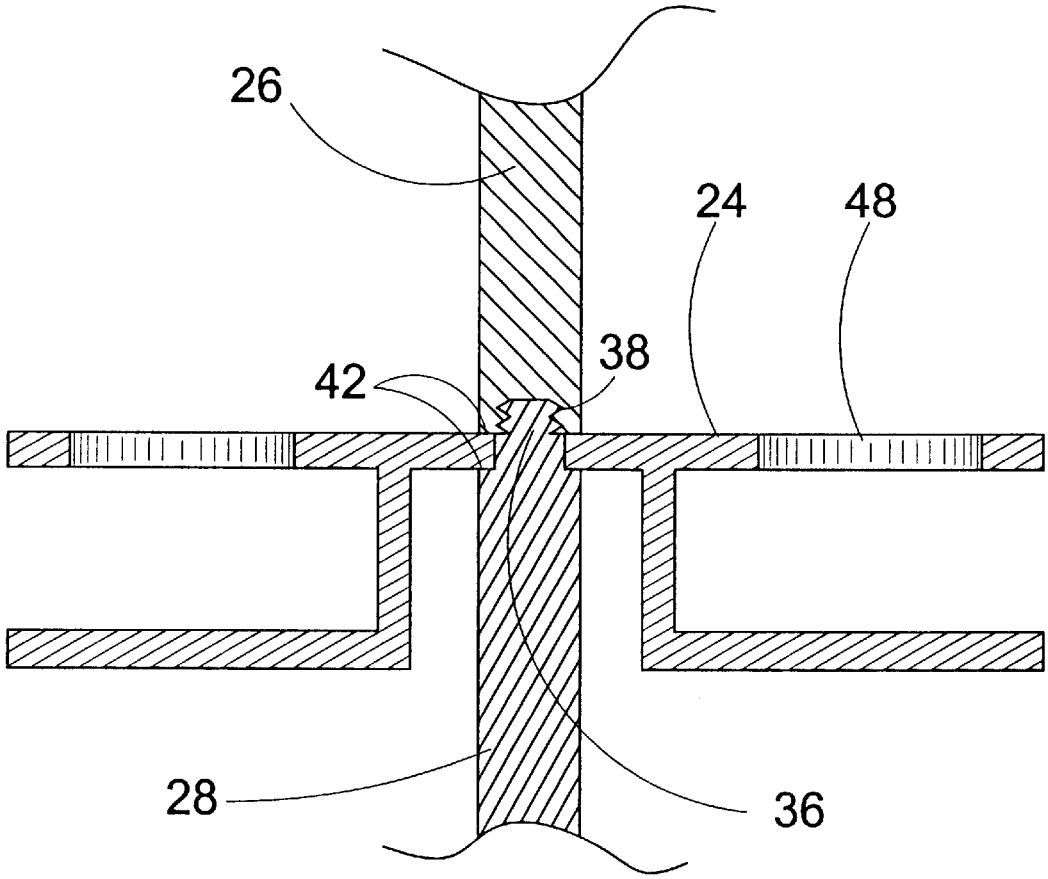
FIG. 10 is a sectional front view of the present invention of the cup holder installed.

Turning to FIG. 10, shown therein is a sectional view of the cup-holder 24 installed. Shown is the cup holder attachment 24 bound between the retaining flanges 42 of two of the post segments 26, 28 of the invention as previously disclosed. The cup holder 24 is located between the two post segments 26, 28 bound tightly by the force of the male 36 and female 38 threads locking the poles 26, 28 together. Also shown are the retaining recesses 48 of the cup holder 24 which recesses receive a cup therein.

Figure 11:
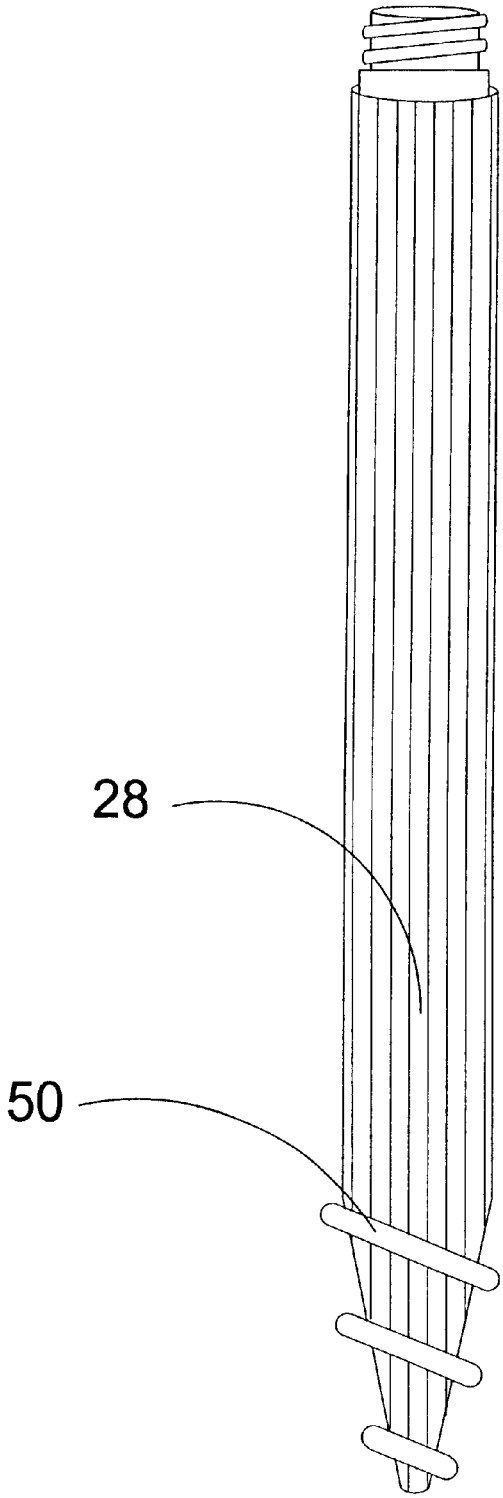
FIG. 11 is a front view of a bottom post segment with an auger-like tapered end.

Turning to FIG. 11, shown therein is a perspective view of the bottom post segment 28 with a tapered, auger-like tip 50. The bottom post segment 28 has an auger-like end 50 option which would enable the user to penetrate the sand or soil by rotating it into the ground. This method would aid in the stability of the invention.

Figure 12:
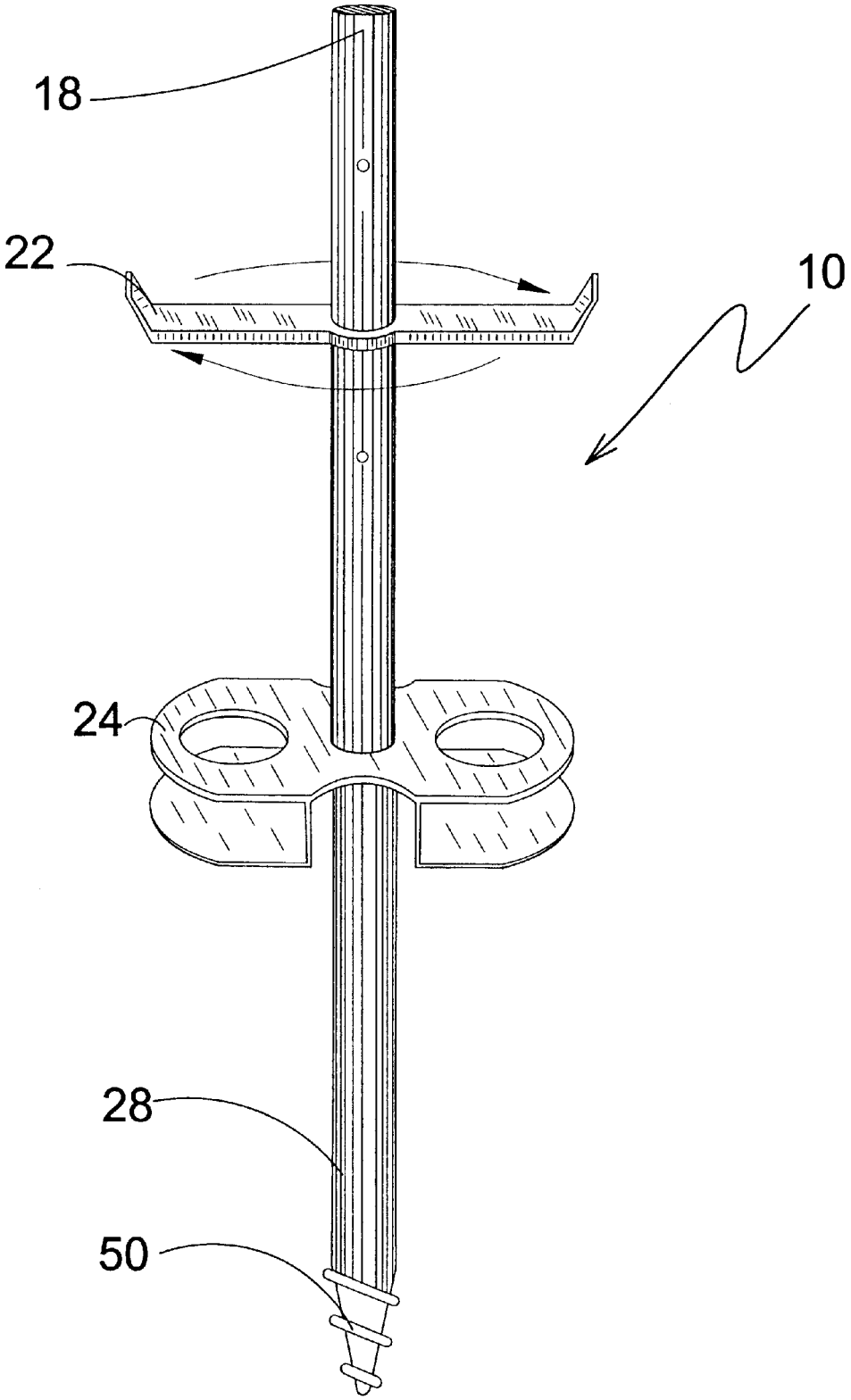
FIG. 12 is a perspective view of the present invention with auger-like tapered end.

Turning to FIG. 12, shown therein is a perspective view of the present invention 10 having an auger-like tip 50 on the distal end of the bottom post segment 28. The idea is that once the present invention 10 has been assembled, the utility hanger 22 could be used as a lever to provide torque to rotate the present invention 10 into the sand or soil requiring less effort inserting the present invention into the ground and increasing the depth of insertion. Also shown are the top section 18 and the cup holder 24.

What is claimed to be new and desired to be protected by Letters Patent is set forth in the appended claims.

I claim:

1. A beach utility pole for standing upright on a beach, comprising:

a) a central post member, said post member being substantially upright standing, said post member comprising a plurality of sections;

b) wherein said plurality of sections comprise at least three sections wherein said three sections comprise a top section, a middle section and a bottom section, wherein each section has a first upper and a second lower opposing end, wherein said second lower end of said bottom section has a pointed end for placement in the beach, and the first upper end of said top section is planar;

c) means for joining said sections together to form said central post member;

d) a plurality of accessory members disposed on said central post member wherein said accessory members are captured between joined ends of said sections to permit the accessory members to be attached to the central post member;

e) a clothes hanger member mounted on the first end of said top section, said clothes hanger member comprises a ring, said ring having a diameter complementary to said first upper end of said top section to permit said ring to frictionally engage the periphery of said first upper end of said top section, further comprising a plurality of downwardly extending wire like elements from said ring and spaced around and up against an outside surface of said top section with each of said elements terminating in a hook to permit clothes to be hung on the hooks; and f) an eastomeric ball having a cylindrical recess therein, wherein said recess is sized to receive said ring and a portion of said downwardly extending wire like elements therein, wherein said ring, said first upper end of said top section, and a portion of said wire like elements are inserted into said recess to permit the clothes hanger member to be secured to the central post member.

2. The beach utility pole of claim 1, wherein said central post member is round.

3. The beach utility pole of claim 2, wherein said accessory members have a central aperture therein, said aperture for receiving said ends of said sections, wherein said aperture has a diameter slightly less than said sections of said central post member to permit the accessory members to be attached to the central post member.

4. The beach utility pole of claim 3, wherein said accessory members comprise a utility hanger member to permit articles to hang thereon.

5. The beach utility pole of claim 4, wherein said accessory members comprise a cup holder member to permit cups to be placed therein.

6. The beach utility pole of claim 5, wherein said means for joining said sections together comprises:

a) a male threaded portion disposed on said first upper ends of said middle and bottom sections; and, b) a female threaded portion disposed on said second lower ends of said top and middle sections to receive said male threaded portions to permit the sections to be joined together to form the central post member.

7. The beach utility pole of claim 6, further comprising a retaining flange formed on said first upper ends of said middle and bottom sections, said flange being formed adjacent to a smooth extruded section disposed on the lower end of said male threaded portion to permit the accessory members to be attached to the central post member.

8. The beach utility pole of claim 7, wherein said smooth extruded section of said male threaded portion has a diameter slightly less than said central aperture of said accessory member, wherein said male threaded portion is inserted into said central aperture of said accessory member, wherein said central aperture of said accessory member mates with said smooth extruded section to permit the accessory member to be captured between joined ends of said sections.

9. The beach utility pole of claim 8, wherein said top and middle sections have a substantially horizontal aperture therein, wherein said horizontal apertures pass through said top and middle sections, wherein a rope passes through said horizontal apertures of said top and middle sections to permit the top and middle sections to be joined to the rope and thereby to each other.

10. The beach utility pole of claim 9, further comprising a pair of oppositely disposed, radially extending arms being disposed on said utility hanger member to permit articles to be hung on the pair of arms.

11. The beach utility pole of claim 10, wherein said cup holder has at last one recess therein, said recess for receiving a cup therein to permit a cup to be placed in the cup holder.

12. The beach utility pole of claim 11, further comprising an auger disposed on said pointed end of said bottom section to permit easier penetration of the bottom section into the beach, wherein said radial arms of said utility hanger are rotated by a user to auger said central post member into the beach.

13. The beach utility pole of claim 12, further comprising a bag for receiving the individual components of the beach utility pole.

* * * * *